United States Patent [19]

Katoh et al.

[11] 4,125,416

[45] Nov. 14, 1978

[54] METHOD FOR PRODUCING STEEL STRIP OR STEEL SHEET CONTAINING CARBIDE AND NITRIDE FORMING ELEMENTS

[75] Inventors: Hiroshi Katoh; Yasumitsu Onoe, both of Kitakyushu; Koichi Kawamura; Osamu Akisue, both of Himeji, all of Japan

[73] Assignee: Nippon Steel Corporation, Tokyo, Japan

[21] Appl. No.: 829,461

[22] Filed: Aug. 31, 1977

[51] Int. Cl.$^2$ ..... C21D 1/02; C21D 7/13

[52] U.S. Cl. ..... 148/12 F; 148/12.3

[58] Field of Search ..... 148/12 F, 12.3

[56] References Cited

U.S. PATENT DOCUMENTS

| | | | |
|---|---|---|---|
| 3,625,780 | 12/1971 | Bosch et al. | 148/12 F |
| 3,904,447 | 9/1975 | Gondo et al. | 148/12.3 |
| 3,928,086 | 12/1975 | Bailey | 148/12.3 |

*Primary Examiner*—W. Stallard

*Attorney, Agent, or Firm*—Wenderoth, Lind & Ponack

[57] ABSTRACT

A method for producing a low carbon deep drawing quality steel or high strength steel in the form of a strip or sheet. At least one of carbide or nitride forming elements is added to the low carbon steel to provide therein 0.015 to 0.10% Sol Al, 0.01 to 0.10% Nb, 0.01 to 0.10% Ti and 0.01 to 0.15% V. The steel is cast or bloomed to form a slab which is held above the $Ar_3$ point for keeping the carbide and nitride forming elements in a dissolved state. Then, without allowing the temperature to fall below the $Ar_3$ point, hot rolling and hot finishing rolling are directly carried out at a temperature above the $Ar_3$ point. Thereafter, if necessary and desirable, the thus-rolled slab or sheet is subjected to cold rolling and annealing.

7 Claims, 1 Drawing Figure

METHOD FOR PRODUCING STEEL STRIP OR STEEL SHEET CONTAINING CARBIDE AND NITRIDE FORMING ELEMENTS

The present invention relates to a method for producing a low carbon steel strip or sheet containing carbide or nitride forming elements. More particularly, the present invention provides a new hot rolling process based on a new metallurgical principle for obtaining a steel product which has excellent qualities, such as deep drawing or high strength, as compared with a steel product which is obtained by a conventional hot rolling process.

BACKGROUND OF THE INVENTION AND PRIOR ART

In the present practice of producing a steel strip or sheet, the starting material is a steel slab which is produced by the ingot process including blooming or by a casting process such as a continuous casting process. The thus-obtained steel slab is cooled down to an ambient temperature. Thereafter, this slab is heated up to a temperature in the range of 1200–1300° C. for more than three hours in a slab reheating furnace. It is then fed to a hot rolling mill and hot rolled into the desired thickness.

From the time of the development of the continuous casting technique, it has been the desire of those in the art to be able to roll continuously a cast steel slab having a high temperature directly, i.e. without the necessity of reheating it. This process of directly rolling the cast steel, hereinafter called a direct hot rolling process, is well-known and well-established and various ways of carrying out this process have been proposed. The main object of this direct hot rolling process in the past has been to make the processing steps of casting and hot rolling continuous and to save energy as compared with the conventional process in which the slab is cooled down to an ambient temperature and reheated in a slab-reheating furnace prior to hot rolling. There has been no consideration of the technical problems to be solved in this direct hot rolling process and how this process would influence the quality of the final product from a metallurgical viewpoint.

The present inventors have carefully studied the relationship between a heat diagram for a steel slab and that for a hot rolled steel strip and have discovered an important relationship between the two steps.

SUMMARY OF THE INVENTION

The present invention is based on the above described discovery and has as its main object the improvement of the quality of the final product produced by a method in which steel containing carbide or nitride forming elements such as acid soluble aluminum (hereinafter called Sol Al), Nb, Ti, and V is rolled by a direct hot rolling process without being cooled between the continuous casting and hot rolling.

Another object of this invention is to provide a method for producing a deep drawing steel using Al-killed steel as a starting material and a method for producing a high strength steel using Si-Al-killed steel as a starting material, which steels include at least one carbide or nitride forming element.

Another object of this invention is to provide a method for producing a high strength steel other than Si-Al-killed steel and containing Nb, Ti and V as a carbide or nitride forming elements.

As a result, a superior quality steel is obtained as compared with the conventional process including cooling and reheating steps.

More particularly, the present invention provides a method for producing a low alloy steel strip or sheet comprising the steps of holding the temperature of a cast or bloomed steel slab which contains at least one carbide or nitride forming element selected from the group consisting of 0.015 to 0.10% Sol Al, 0.01 to 0.10% Nb, 0.01 to 0.10% Ti and 0.01 to 0.15% V above the $Ar_3$ point for keeping the carbide or nitride forming elements dissolved from the casting or blooming stage to the hot rolling step and directly carrying out the hot rolling at a temperature above the $Ar_3$ point. If necessary, heat can be added to hold the temperature above the $Ar_3$ point.

BRIEF DESCRIPTION OF THE DRAWINGS

The invention will now be described in greater detail in connection with the attached FIGURE which is a graph of the relationship of the tensile strength of the finished steel and the minimum slab temperature before rolling.

DETAILED DESCRIPTION OF THE INVENTION

Figure 1:
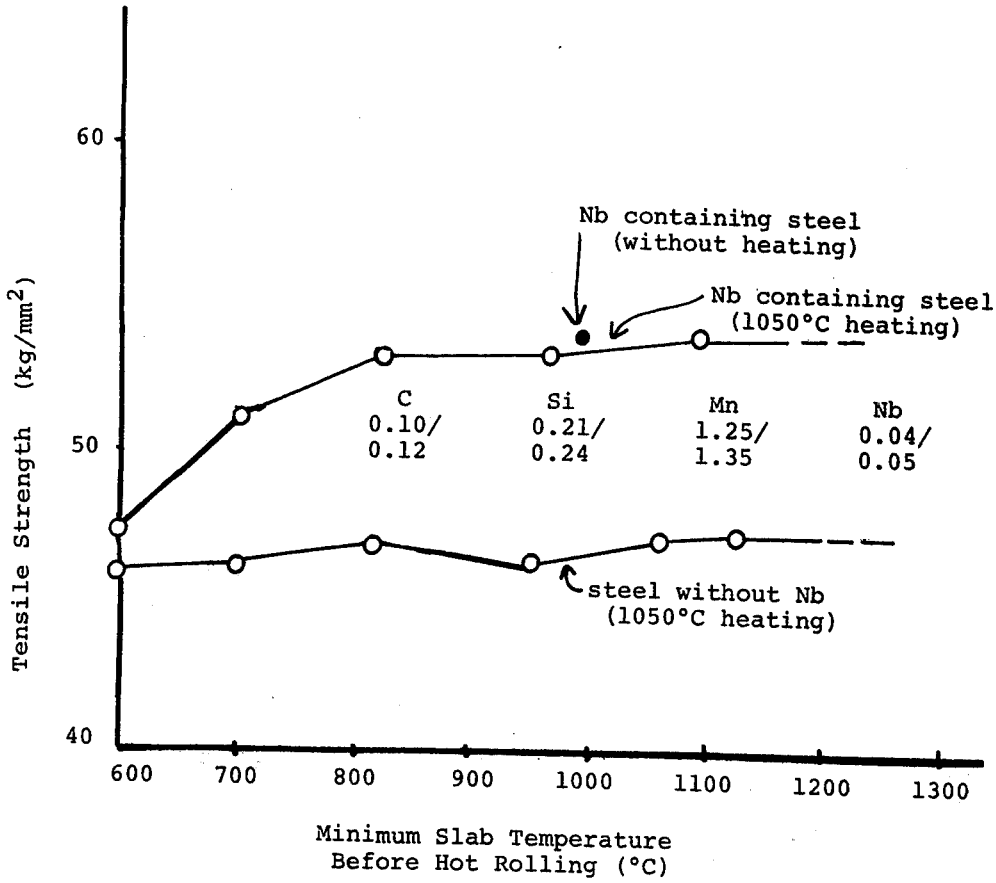

The process of the present invention basically comprises hot rolling a slab of steel which includes at least one carbide or nitride forming element such as Sol Al, Nb, Ti and V, which steel, while it moves from the casting or blooming step to the hot rolling operation, has the temperature maintained above the $Ar_3$ point. It has been found out that when this condition is maintained, carbides or nitrides which are precipitated after hot rolling are uniformly precipitated and finely dispersed in the hot steel during succeeding steps. These precipitates act effectively during the succeeding steps to raise the quality of the final product.

According to the conventional sheet or strip process, the cast or bloomed steel slab is cooled down to an ambient temperature before being hot rolled. In the cold slab, the carbides and nitrides are completely precipitated and they grow to large grains during the cooling. Therefore, in the conventional process, a high temperature reheating for several hours is necessary in order to re-dissolve these precipitates and keep them in the dissolved state before starting the hot rolling operation.

However, even if these precipitates are completely redissolved by this reheating step, each element is not completely and uniformly re-dispersed in the steel in the dissolved state. Therefore, when the carbide or nitride again precipitate in succeeding steps, these precipitates do not re-precipitate uniformly, and are not effective for achieving the desired qualities of the steel.

In a hot slab which has been produced by an ingot process or a continuous casting process, each element is in a dissolved and uniformly dispersed state, and the present invention effectively utilizes this steel as a starting material for producing a final product having a deep drawing quality or high strength.

The carbide or nitride precipitates having an important influence on the quality of steel are AlN, Nb(CN), TiC and V(CN). The present inventors have studied the behavior of these precipitates with respect to ingot casting, continuous casting, heating, hot-rolling, and annealing respectively, and from the results of these studies have determined the most favorable condition for producing steel strips or sheets containing at least one of the elements from the group of Sol Al, Nb, Ti and V for achieving the purpose of this invention.

In the method of this invention, carbide or nitride forming elements are kept in the dissolved state in the steel by keeping the steel at a temperature above the $Ar_3$ point from the casting or blooming step to the start of the hot rolling, and then the slab is directly hot rolled without the temperature thereof being allowed to fall. If necessary, heat can be added so that a uniform temperature of the entire slab is maintained. This heating is carried out by heating the slab to a temperature below 1280° C., preferably no higher than 1250° C., rather than heating to a temperature much higher than the $Ar_3$ point as in a conventional high temperature slab reheating process.

The precipitates have many purposes. One of these purposes is controlling the recrystallization texture, and another is controlling recrystallized grain size and shape and, in addition, achieving a certain strength of the steel material.

The most important aspects of these precipitates are the time at which they are formed and the physical form of the precipitates and their dispersion in the steel. For example, when we use Al-killed steel for producing a cold rolled steel sheet, it is important to control the texture of the recrystallized grains for producing steel with a good deep drawing quality by developing a recrystallized texture which is favorable to deep drawability. To achieve this, conventionally after hot rolling, Al and N are kept dissolved by, for instance, coiling the hot rolled strip at a low temperature, e.g. from 500° to 650° C., and the Al and N are precipitated as AlN at the time of annealing after cold-rolling.

As a result of an extensive study of the precipitating conditions for AlN in Al-killed steel, the present inventors have also discovered a specific way for achieving the most favourable conditions of the precipitates, which comprises feeding a slab to the hot rolling mill at a temperature of more than 900° C. without having allowed the temperature of the slab to fall below the $Ar_3$ point from the casting step to the rolling step. In the present invention, a subsequent annealing can be carried out by a box annealing process or a continuous annealing process. When the continuous annealing process is adopted, higher coiling temperature from 650° to 750° C. after hot rolling is favourable to develop the drawability of sheets.

In the above-described conventional process, in carrying out the common practice of reheating for several hours before feeding of the slab into the hot rolling mill, the cooled slab must be reheated for more than three hours at a temperature above 1200° C. in the reheating furnace for redissolving Al and N. However, even when heating at this temperature and for this time, these elements are not uniformly dispersed in the reheated slab.

On the other hand, it has been found according to the present invention, that for a continuous cast slab or a bloomed steel slab made of an Al-killed steel, AlN precipitation does not take place between the high temperature formation of the slab and hot rolling if the slab temperature is kept above the relatively low temperature of about 900° C. The present invention can thus obtain the best effects of these precipitates in the successive steps of forming the steel into the final product.

When a soft material such as the above described Al-killed steel is used according to the method of the present invention to produce a hot rolled steel to be rolled to a cold rolled steel sheet, the steel composition must be limited as follows:

$C \leqq 0.15\%$
$Mn \leqq 0.50\%$
$N = 0.0020 \sim 0.0150\%$; Sol Al $= 0.015 \sim 0.10\%$ with the balance being Fe and impurities.

The carbon content must not be present in an amount more than 0.15% because when carbon in an amount more than 0.15% is present, it causes hardening of the hot and subsequently cold rolled steel sheet, and also reduces the workability.

The manganese content must also not be present in an amount more than 0.50% in order to ensure good workability because when the manganese content increases to more than 0.50%, this causes extreme deterioration of the workability.

Furthermore, in Al-killed steel, it is necessary to develop a recrystallized texture in which the {111} planes of crystals are parallel to a rolling plane to increase the workability of the steel so that it is suitable as a deep drawing cold rolled steel sheet. For this reason, the amount of soluble aluminum and the amount of nitrogen must be kept within the ranges of 0.015 to 0.10% Sol Al and 0.0020 to 0.015% N, respectively. If the amounts of these elements are kept within these ranges, the Al-killed steel can be formed into a hot rolled steel strip or sheet having excellent workability.

With respect to high strength hot rolled Al-Si-killed steel, it is important to control the grain structure by the use of Al and N for producing a fine grain steel having excellent toughness. It is well known that in the conventional process for producing this kind of fine grain steel, the Al and N must be dissolved in the steel by reheating the slab at the time of hot rolling, and the hot rolled strip must be subjected to a final hot rolling at a temperature above the $Ar_3$ point. This strip is then coiled at a relatively low temperature, e.g. 500° to 650° C., for keeping the Al and N dissolved or in the preprecipitation state of AlN, so that a fine grain will be produced in a subsequent step, such as a normalizing step for precipitation of the AlN. After a detailed study of AlN precipitates in Al-Si-killed steel, the present inventors have found that in order to obtain a high strength Al-Si-killed steel having excellent workability and toughness that the cast slab or the bloomed slab must be directly fed to the hot rolling mill without allowing the temperature to fall below the $Ar_3$ point. If necessary, heat can be added to maintain the desired temperature. In this Al-Si-killed steel which is to be formed into a high strength steel, the starting composition must be limited as follows:

$C \leqq 0.21\%$
$Mn = 0.70–1.60\%$
$Si = 0.10–0.40\%$
Sol Al $= 0.015–0.10\%$
$N = 0.0015–0.0150\%$ with the balance being Fe and impurities.

Carbon is effective for increasing the strength, but excessive amounts of C cause deterioration of the toughness and weldability of the steel, so that the carbon content must be limited to not more than 0.21%. Manganese and silicon are also effective to ensure that the strength is good without causing deterioration of the toughness, but excessive amounts of these elements cause deterioration of the weldability. For this reason, the manganese content must be limited to the range of 0.70 to 1.60% and the silicon content must be limited to the range of 0.10 to 0.40%. Al and N which are used to obtain the fine crystal grain which gives the steel its good toughness must be limited to the range of 0.015 to 0.10% for Sol Al and the range of 0.0015 to 0.0150% for N. If the Sol Al and N are kept within these ranges, the Si-Al killed steel which is subjected to the method of the invention to produce hot rolled and, if desired, normalized steel will have good toughness qualities. In addition, the Si-Al killed steel treated according to the present method will produce a weldable steel material having excellent toughness.

In producing a high strength steel which includes Nb, Ti and/or V, it is very important to increase the strength by providing in such steel finely and uniformly dispersed precipitates of Nb(CN), TiC and/or V(CN).

For this purpose, Nb, Ti and/or V, and C and N must be completely dissolved in the hot slab before the hot rolling operation and after the finishing of the hot rolling, Nb(CN), TiC and/or V(CN) must then be precipitated in the hot rolled strip.

After a careful study of the precipitation of Nb(CN), TiC and/or V(CN) in steel which contains Nb, Ti and/or V, the present inventors have found that to obtain a desired high strength in the hot rolled steel, the cast slab or the bloomed high temperature slab must be directly fed to the hot rolling mill without allowing the temperature to fall below the $Ar_3$ point. If necessary, heat can be added to maintain the temperature. For a high strength steel which contains Nb, Ti and/or V, and having a tensile strength between 50 $Kg/mm^2$ and 70 $Kg/mm^2$, the steel composition must be limited as follows:

C = 0.06 ~ 0.20%
Mn = 0.50 ~ 2.0%
Si = 0.30 ~ 0.5% at least one element from the group consisting of Nb, Ti or V

Nb = 0.01 ~ 0.10%
Ti = 0.01 ~ 0.10%
V = 0.01 ~ 0.15% with the balance being Fe and impurities.

Carbon, manganese and silicon are basic elements for ensuring the workability and achieving the desired strength level, and for these reasons, these basic elements must be present in minimum amounts of more than 0.06% carbon, more than 0.50% manganese and more than 0.03% silicon, respectively.

However excessive amounts of these elements causes loss of the desired workability which is required for hot-rolled strength steel. Therefore, the maximum amounts of these elements must be limited to not more than 0.20% carbon, not more than 2.00% manganese and not more than 0.50% silicon, respectively.

Concerning the additional elements Nb, Ti and/or V, these must be present in amounts of 0.01 to 0.10% Nb, 0.01 to 0.10% Ti and 0.01 to 0.15% V, respectively. If these additional elements are present in smaller amounts than the above described amounts, they will not have sufficient influence to increase the strength. On the other hand, if amounts in excess of those set forth are added, no further effect is achieved. These additional elements can be added to the steel singly or in groups, according to the required strength and toughness.

Other elements which can be included in this high strength steel are elements such as P, Ni, Cr, Mo, Cu and Al, which increase the degree of corrosion resistance, wear resistance and the like. If the steel is to have the increased strength, the maximum amount of these elements which can be added without reducing the effect of the Nb, Ti and/or V which is required is about 1%.

FIG. 1 shows the manner in which the lowest temperature of the cast slab before heating or hot rolling influences the strength of steel with and without Nb and which is hot rolled from the cast slab according to the method of the present invention. From FIG. 1, it can be seen that the critical feature affecting the strength of Nb containing steel formed from a slab rolled at a temperature of 1050° C. is the minimum temperature to which the slab has been allowed to fall prior to hot rolling. When the minimum temperature of the cast slab is above $Ar_3$ point before reheating, the strength of the steel is kept high. The lowest temperature to which the Nb containing steel slab can be allowed to fall is about 800° C. The heating necessary to raise the temperature from about 800° C. to the slab rolling temperature is not a reheating in the conventional sense, but rather is only a temperature maintaining and adjusting heating.

The strength phenomenon is due to the way in which the precipitate, Nb(CN) is formed in steel which has never been allowed to cool below the $Ar_3$ temperature. When the method of the present invention is used and the slab temperature is not allowed to fall below the $Ar_3$ point, the precipitation of Nb(CN) does not occur before final finishing hot rolling, and this Nb(CN) is finely precipitated only after the final finishing hot rolling. This results in an increase in the strength of the steel.

On the other hand, when the temperature of the slab has once fallen below the $Ar_3$ point, Nb(CN) is completely precipitated, and it is not completely redissolved and uniformly dispersed in the steel even if the slab is reheated up to 1050° C. Therefore, the precipitation of Nb(CN) before hot rolling is detrimental to the final strength. As can be seen from FIG. 1, if the temperature of the slab is never allowed to fall below the $Ar_3$ point so that a reheating step is unnecessary, the strength of the final product produced from the slab by hot rolling is high as in the case of a minimum slab temperature of about 1000° C.

After the hot rolling, the slab of steel containing Nb, Ti and/or V is coiled at a low temperature, e.g. 450°–650° C., for causing precipitation of the Nb(CN), TiC and/or V(CN) and is then subjected to cold rolling and box or continuous annealing for obtaining a high strength cold rolled steel sheet having excellent workability. The high strength is produced by uniform dispersion of the carbide and nitride precipitates as above described.

The present invention will be more clearly understood from the following examples.

EXAMPLE 1

Al-killed steels having slightly different compositions as shown in Table I and which were produced in a converter or were produced in a converter and then treated by a vacuum degassing treatment were formed into a slab, either by a continuous casting process or blooming after being cast in an ingot process. The thus-formed slabs were directly hot rolled, including maintenance heating or reheating when necessary and hot rolled according to the conditions in Table I for obtaining a hot rolled steel having having a thickness of 2.8 mm. The thus obtained Al-killed hot rolled steel sheet was further subjected to a cold rolling step for obtaining a final thickness of 1.0 mm after pickling. Thereafter, a recrystallization annealing at 710° C. for 6 hours was carried out and the steel sheet was further temper rolled to reduce the thickness by about 1.2%.

Table 1 shows the specific chemical compositions of the steels treated according to the present invention and the mechanical properties of steel sheets resulting from the processing steps. For the steel compositions A-1 to A-6, the slab was not allowed to fall below a temperature of 900° C., i.e. not below the $Ar_3$ point. In some cases, the heat was maintained or increased slightly to the temperature at the time of changing into the rolling mill for hot rolling. The steel composition A-7 was directly hot rolled into a hot strip without maintenance heating and without the temperature of the slab falling below the $Ar_3$ point from the time of blooming or continuous casting to the time of hot rolling.

On the other hand, the slabs from steel compositions B-1 to B-3 were allowed to fall below 850° C., i.e. below the $Ar_3$ point, before being charged into a reheating furnace for heating up to 1100° C. for hot rolling.

A comparision of the quality of the steel compositions A-1 to A-7 of the steel treated according to the present invention with the quality of compositions B-1 to B-3 shows that the final product of the steel treated by the method of the present invention is much softer, has a lower yield point and lower tensile strength, and also has a greater elongation. In addition, the steels from compositions A-1 to A-7 have excellent properties, such as a high Er value and a high $\bar{r}$ value and also have excellent deep drawability and stretchability. In the steels of compositions B-1 to B-3, the slabs of which were lowered to a temperature below the $Ar_3$ point, AlN was precipitated at the time of initial cooling, so that AlN was not completely dissolved and uniformly distributed in the steel even when the slabs were reheated in the heating furnace. Therefore, the $\bar{r}$ value of these products was very low. Compositions A-1 to A-5 are especially within the scope of the present invention and since the slab temperature was never lowered below the $Ar_3$ point, no AlN precipitation occurred in the slab prior to the end of rolling, even where the slab was heated up to 1100° C. at the start of rolling. As a result, it is possible to obtain steel sheets having a high $\bar{r}$ value, i.e. more than 1.6, and a high Er value, i.e. more than 12.0. It is to be noted that the steel composition B-4 produced by a conventional process, which involved reheating a cold slab to 1250° C. for dissolving the precipitated AlN, then subjecting the reheated slab to the usual hot rolling and cold rolling steps is poor in that the steel has a low yield point, as well as a low Er value and a low $\bar{r}$ value.

From a theoretical standpoint, concerning the steel compositions A-1 to A-7, there are two major factors.

Firstly, AlN is not precipitated before the hot rolling operation.

Secondly, Al and N are uniformly dispersed and dissolved in the entire high temperature slab after blooming or casting and solidification and the precipitation of AlN starts for the first time at the time of recrystallization annealing and a good recrystallization texture develops which gives the steel good workability.

In the steel composition B-4, AlN is completely precipitated in the slab during the slab cooling step, and although the AlN is redissolved to Al and N during the reheating step, it is not uniformly dispersed in the slab because of the limited conditions during the actual operation, such as heating time and temperature, and it is difficult to develop a preferable recrystallization texture for obtaining good workability by the subsequent recrystallization annealing.

EXAMPLE II

Molten Si-Al killed steel having a ladle composition of 0.15% C, 0.25% Si, 1.35% Mn, 0.013% P, 0.014% S, 0.03% Sol Al, 0.0045% N and the balance Fe and impurities, was prepared in a 100-ton converter and cast in a slab by a continuous casting process. Al-Si-killed steel slabs obtained in this way were treated according to the conditions shown in Table 2. Each slab was also hot rolled to a thickness of 25 mm and aircooled, and the mechanical properties were determined. Furthermore, the hot-rolled steel was annealed at 890° C. for 15 minutes and the mechanical properties determined.

According to the test results, the steel of heats C-1 and C-2 had better properties, such as yield point, tensile strength, elongation and charpy value, than the steel of heats D-1 and D-2, which were produced by the conventional process. In the steel of heats C-1 and C-2 which were directly hot rolled without allowing the temperature to fall below the $Ar_3$ point before the hot rolling step, Al and N were caused to precipitate after the hot rolling stage in fine grains to form a finely grained steel structure in which the precipitated aluminum nitrides are distributed uniformly throughout the steel structure. Such fine grain steel is characterized by having excellent strength and charpy values as seen in Table 2.

On the other hand, in the steel of heats D-1 and D-2 which had the temperature lowered to a temperature below the $Ar_3$ point prior to hot rolling, AlN was completely precipitated when the slab was cooled, and complete redissolution of the AlN was not achieved by the relatively low reheating temperature of heat D-1. In heat D-2, in which the AlN was dissolved at the high reheating temperature, Al and N were not dissolved and dispersed uniformly throughout the entire slab. Therefore, the benefits of the Al and N were not fully achieved in the steels of heats D-1 and D-2. After the hot rolled and air-cooled heats C-1, C-2, D-1 and D-2 were annealed by heating at 890° C. for 15 minutes, and then air cooled, the mechanical properties of the steel of heats C-1 and C-2, such as yield point, tensile strength, elongation, charpy value and grain size, were good as compared with the same properties of the steel of heats D-1 and D-2.

EXAMPLE III

Nb, Ti and V containing steels having the compositions as shown in Table 3 were cast into slabs having a temperature more than 750° C. Slabs having compositions E-1 to E-6 were directly hot rolled, or hot rolled after further heating. Some of the slabs, i.e. those having compositions F-1 and F-2, were air cooled to an ambient temperature and then reheated and hot rolled. From the results of tests to determine the mechanical properties as shown in Table 3, the finished steel from compositions E-1 to E-6 had higher values of tensile strength and toughness (vE-60) as compared to the steel of compositions F-1 and F-2. Even though the steel compositions E-6 and F-1 are the same, the steel having composition F-1 was cooled to a temperature below the $Ar_3$ point prior to rolling and thus had a lower strength than composition E-6 which never had the temperature fall below the $Ar_3$ point prior to rolling

EXAMPLE IV

Nb, Ti and V containing steels having the compositions G-1 and G-2 were cast and some of the cast slabs which were at a temperature more than 800° C. were directly charged to a heating furnace, and then hot rolled without allowing the temperature thereof to fall. Other slabs from similar steels having compositions H-1 and H-2 were similarly cast and cooled down to ambient temperature, then reheated and hot rolled. The thus-obtained hot rolled steel strip having a thickness of 3.0 mm was cold rolled to a thickness of 1.0 mm, was then subjected to annealing at 700° C. for 2 hours and further temper rolled at a rate of reduction of 1.5%. Thereafter, the mechanical properties of the respective steels were determined. The slabs having compositions G-1 and G-2, which were treated according to the present invention by keeping the temperature thereof above 830° C. prior to rolling, had excellent properties as shown in Table 4, especially with respect to the balance between strength and ductility, as compared with the steels having compositions H-1 and H-2. The steels having compositions G-1 and G-2 also had a higher level of strength than the steels having compositions H-1 and H-2, because the carbide and nitride forming elements were precipitated so as to be effective to ensure the higher strength thereof.

TABLE 1

| | Coil No. | Chemical Composition* (%) C | Mn | Si | P | S | Sol Al | N | Treatment of Al-Killed Steel: minimum slab temperature (° C) | slab temp. at start of rolling (° C) | Hot rolling conditions: finishing temp. (° C) | coiling temp. (° C) | Reduction rate-cold rolling (%) | Mechanical Properties: yield point (kg/mm$^2$) | tensile strength (kg/mm$^2$) | El (%) | Er (mm) | $\bar{\gamma}$ |
|---|---|---|---|---|---|---|---|---|---|---|---|---|---|---|---|---|---|---|
| Treatment according to present invention | A-1 | 0.053 | 0.24 | 0.01 | 0.01 | 0.01 | 0.048 | 0.0072 | 1000 | 1100 | 900 | 550 | 64 | 16.5 | 32.8 | 47.2 | 12.7 | 1.68 |
| | A-2 | 0.041 | 0.30 | 0.01 | 0.01 | 0.01 | 0.055 | 0.0035 | 1100 | 1100 | 885 | 520 | 64 | 17.3 | 33.2 | 46.5 | 12.4 | 1.64 |
| | A-3 | 0.048 | 0.29 | 0.01 | 0.01 | 0.01 | 0.053 | 0.0065 | 955 | 1080 | 865 | 510 | 64 | 18.2 | 33.0 | 45.5 | 12.8 | 1.71 |
| | A-4 | 0.055 | 0.27 | 0.01 | 0.01 | 0.01 | 0.078 | 0.0100 | 900 | 1000 | 850 | 490 | 64 | 19.3 | 34.1 | 46.2 | 12.3 | 1.62 |
| | A-5 | 0.010 | 0.19 | 0.01 | 0.01 | 0.01 | 0.0035 | 0.0050 | 985 | 1050 | 865 | 500 | 64 | 15.2 | 30.1 | 48.2 | 12.9 | 1.89 |
| | A-6 | 0.060 | 0.30 | 0.01 | 0.01 | 0.01 | 0.040 | 0.0045 | 950 | 1250 | 895 | 550 | 64 | 17.4 | 32.1 | 46.2 | 12.5 | 1.70 |
| | A-7 | 0.052 | 0.29 | 0.01 | 0.01 | 0.01 | 0.060 | 0.0055 | 1050 | 1050 | 900 | 550 | 64 | 16.8 | 33.6 | 46.7 | 12.4 | 1.69 |
| Conventional treatment | B-1 | 0.043 | 0.30 | 0.01 | 0.01 | 0.01 | 0.049 | 0.0053 | 850 | 1100 | 875 | 535 | 64 | 23.4 | 35.2 | 45.3 | 11.4 | 1.33 |
| | B-2 | 0.049 | 0.29 | 0.01 | 0.01 | 0.01 | 0.048 | 0.0048 | 800 | 1100 | 875 | 530 | 64 | 22.5 | 36.1 | 44.8 | 11.8 | 1.35 |
| | B-3 | 0.052 | 0.29 | 0.01 | 0.01 | 0.01 | 0.057 | 0.0076 | 300 | 1100 | 870 | 520 | 64 | 23.6 | 34.8 | 43.5 | 11.3 | 1.38 |
| | B-4 | 0.050 | 0.27 | 0.01 | 0.01 | 0.01 | 0.050 | 0.0045 | 20 | 1250 | 905 | 550 | 64 | 17.8 | 31.2 | 46.4 | 11.9 | 1.55 |

*Balance of all compositions is Fe and impurities

TABLE 2

| | | Treatment of Al-SI-Killed Steel | | | | | | | | Mechanical Properties after annealing (890° C × 15 minutes) | | | | |
|---|---|---|---|---|---|---|---|---|---|---|---|---|---|---|
| | | | | | Mechanical Properties (as hot rolled) | | | | | | | | | |
| | Coil No. | minimum slab temperature (° C) | slab temperature at start of rolling (° C) | hot rolling finishing temp. (° C) | yield point (kg/mm²) | tensile strength (kg/mm²) | El (%) | vE-20 (kg-m) | GS No. | Y.P. (kg/mm²) | T.S. (kg/mm²) | El (%) | vE-20 (kg-m) | GS No. |
| Treatment according to present invention | C-1 | 950 | 1100 | 900 | 36.4 | 52.4 | 29.2 | 15.3 | 6.7 | 36.6 | 53.7 | 30.2 | 15.8 | 7.5 |
| | C-2 | 1040 | 1040 | 890 | 36.6 | 53.4 | 29.0 | 15.0 | 6.5 | 36.5 | 53.5 | 30.0 | 16.0 | 7.5 |
| Conventional treatment | D-1 | 700 | 1100 | 900 | 34.2 | 52.0 | 28.5 | 13.2 | 5.7 | 34.2 | 52.6 | 30.1 | 15.0 | 6.4 |
| | D-2 | 20 | 1250 | 900 | 35.5 | 53.5 | 28.5 | 14.5 | 6.0 | 35.0 | 53.0 | 30.5 | 15.5 | 7.0 |

TABLE 3

| | | Treatment of Nb, Ti and V containing steel | | | | | | | | | | | | | | | |
|---|---|---|---|---|---|---|---|---|---|---|---|---|---|---|---|---|---|
| | Coil No. | Chemical Composition* | | | | | | | | | | | thickness (mm) | minimum slab temp. before hot rolling (° C) | slab temp. of hot rolling (° C) | Mechanical properties | |
| | | C | Si | Mn | Ni | Cr | Mo | Cu | Nb | V | Ti | Al | | | | tensile strength (kg mm²) | vE-60 (kg-m) |
| Treatment according to present invention | E-1 | 0.12 | 0.24 | 1.25 | | | | | 0.04 | 0.03 | 0.01 | 0.02 | 20 | 1000 | 1250 | 65 | 19.5 |
| | E-2 | 0.06 | 0.21 | 1.18 | 0.64 | 0.10 | 0.05 | 0.20 | 0.03 | | 0.01 | 0.03 | 20 | 980 | 1050 | 61 | 12.8 |
| | E-3 | 0.06 | 0.21 | 1.18 | 0.64 | 0.10 | 0.05 | 0.20 | 0.03 | | 0.01 | 0.03 | 20 | 980 | 980 | 62 | 16.4 |
| | E-4 | 0.10 | 0.23 | 1.31 | | | | | 0.04 | | 0.01 | 0.04 | 16 | 830 | 1250 | 58 | 18.1 |
| | E-5 | 0.11 | 0.23 | 1.26 | | | | | 0.04 | 0.07 | | 0.03 | 16 | 800 | 1050 | 60 | 21.3 |
| | E-6 | 0.07 | 0.26 | 1.25 | 0.50 | | 0.09 | 0.20 | 0.05 | | 0.01 | 0.03 | 16 | 1000 | 1100 | 62 | 24.4 |
| Conventional treatment | F-1 | 0.07 | 0.26 | 1.25 | 0.50 | | 0.09 | 0.20 | 0.05 | | 0.01 | 0.03 | 16 | 20 | 1050 | 56 | 24.0 |
| | F-2 | 0.09 | 0.25 | 1.33 | | | | | 0.04 | | | 0.03 | 20 | 20 | 1250 | 56 | 2.7 |

TABLE 4

| | Coil No. | Chemical Composition* C | Si | Mn | Ni | Mo | Cu | Nb | V | Ti | Al | Treatment of Nb, Ti and V containing steel: minimum slab temp. before heating (° C) | slab temp. at start of rolling (° C) | thickness of hot rolled strip (mm) | thickness of cold rolled strip (mm) | Mechanical Properties: Y.P. ($kg/mm^2$) | T.S. ($kg/mm^2$) | El (%) |
|---|---|---|---|---|---|---|---|---|---|---|---|---|---|---|---|---|---|---|
| Treatment according to present invention | G-1 | 0.10 | 0.23 | 0.31 | | | | 0.04 | | 0.01 | 0.04 | 850 | 1250 | 3.0 | 1.0 | 48.1 | 56.2 | 26.4 |
| | G-2 | 0.11 | 0.23 | 1.26 | | | | 0.04 | 0.07 | | 0.03 | 830 | 1050 | 3.0 | 1.0 | 49.3 | 58.0 | 25.2 |
| Conventional treatment | H-1 | 0.07 | 0.26 | 1.25 | 0.50 | 0.09 | 0.20 | 0.05 | | 0.01 | 0.03 | 20 | 1050 | 3.0 | 1.0 | 43.7 | 52.3 | 27.6 |
| | H-2 | 0.09 | 0.25 | 1.33 | | | | 0.04 | | | 0.03 | 20 | 1250 | 3.0 | 1.0 | 47.5 | 54.7 | 26.3 |

*balance of compositions Fe and impurities

What is claimed is:

1. A method for producing a rolled low carbon steel comprising:

forming a steel slab from a low carbon steel composition containing at least one carbide or nitride forming element selected from the group consisting of 0.015 to 0.10% Sol Al, 0.01 to 0.10% Nb, 0.01 to 0.10% Ti, and 0.01 to 0.15% V, by a forming process in which the finished slab is at a temperature above the $Ar_3$ point of the steel and in which the said element is dissolved and dispersed evenly throughout the slab;

maintaining the temperature of the thus-formed slab at a temperature no lower than the $Ar_3$ point of the low carbon steel from the time of the formation of the slab until the start of rolling of the slab; and directly carrying out hot rolling of the slab at a temperature above the $Ar_3$ point of the low carbon steel.

2. A method according to claim 1, which further comprises cold rolling the hot rolled strip and annealing the thus cold rolled strip.

3. A method according to claim 2, in which the steel is Al-killed steel containing C in an amount not more than 0.15%, Mn in an amount not more than 0.50%, 0.0020 to 0.015% N, and 0.015 to 0.10% Sol Al, with the balance being essentially iron and unavoidable impurities.

4. A method according to claim 1, in which the steel is a Si-Al-killed steel containing C in an amount not more than 0.21%, 0.70 to 1.60% Mn, 0.10 to 0.40% Si, 0.0015 to 0.015% N and 0.015 to 0.10% Sol Al, with the balance being essentially iron and unavoidable impurities.

5. A method according to claim 1, wherein the steel contains 0.01 to 0.20% C, 0.50 to 2.00% Mn, 0.03 to 0.50% Si, 0.0075 to 0.150 N and at least one of the elements taken from the group consisting of sol. Al in an amount of 0.015 to 0.10%, Nb in an amount of 0.01 to 0.10%, Ti in an amount of 0.01 to 0.10%, and V in an amount of 0.01 to 0.15%, with the balance being essentially iron and unavoidable impurities.

6. A method according to claim 5, further comprising cold rolling the hot rolled steel and annealing the cold rolled strip.

7. A method as claimed in claim 5, in which said steel further contains at least one alloying element from the group consisting of P, Ni, Cr, Mo, Cu and Al.

* * * * *